US007591395B2

(12) United States Patent
Hamaguchi

(10) Patent No.: US 7,591,395 B2
(45) Date of Patent: Sep. 22, 2009

(54) ACCELERATION/DECELERATION MECHANISM AND VEHICLE SMALL ARTICLE COMPARTMENT HAVING ACCELERATION/DECELERATION MECHANISM

(75) Inventor: Tsuyoshi Hamaguchi, Sagamihara (JP)

(73) Assignee: Nifco Inc., Yokohama-Shi, Kanagawa (JP)

( * ) Notice: Subject to any disclaimer, the term of this patent is extended or adjusted under 35 U.S.C. 154(b) by 720 days.

(21) Appl. No.: 11/204,039

(22) Filed: Aug. 16, 2005

(65) Prior Publication Data

US 2006/0037965 A1 Feb. 23, 2006

(30) Foreign Application Priority Data

Aug. 18, 2004 (JP) ..... 2004-238770

(51) Int. Cl.
*B65D 43/16* (2006.01)
*B65D 43/22* (2006.01)

(52) U.S. Cl. ..... 220/830; 220/833; 220/835

(58) Field of Classification Search ..... 220/830, 220/831, 815, 833, 835, 827; 296/24.32, 296/37.8; 16/280, 293, 296, 304, 306
See application file for complete search history.

(56) References Cited

U.S. PATENT DOCUMENTS 1,242,440 A * 10/1917 Hick ..... 220/324
5,079,797 A * 1/1992 Ohshima et al. ..... 16/82
5,121,521 A * 6/1992 Hagiwara et al. ..... 16/278
5,280,848 A * 1/1994 Moore ..... 224/282
5,520,313 A * 5/1996 Toshihide ..... 224/539
5,620,122 A * 4/1997 Tanaka ..... 224/275
5,718,405 A * 2/1998 Adachi ..... 248/311.2
5,887,930 A * 3/1999 Klein ..... 296/37.12
6,155,443 A 12/2000 Benedetti
6,470,627 B2 * 10/2002 Fukuo ..... 49/260
6,609,631 B2 * 8/2003 Asami ..... 220/817
6,662,405 B2 * 12/2003 Vitry ..... 16/355
7,231,692 B2 * 6/2007 Harada ..... 16/345
2001/0014993 A1 * 8/2001 Orita ..... 16/82
2001/0039694 A1 11/2001 Cau
2001/0052524 A1 * 12/2001 Ichimaru et al. ..... 220/815
2003/0071047 A1 * 4/2003 Harada ..... 220/835
2003/0080131 A1 * 5/2003 Fukuo ..... 220/264
2003/0132234 A1 * 7/2003 Hirose ..... 220/830
2004/0020935 A1 2/2004 Inari
2005/0133507 A1 * 6/2005 Tanaka ..... 220/263
2005/0248170 A1 * 11/2005 Kawamoto et al. ..... 296/24.34
2007/0034636 A1 * 2/2007 Fukuo ..... 220/830

FOREIGN PATENT DOCUMENTS

EP 0 501 021 9/1992
GB 2 412 097 9/2005
JP 2002-178818 6/2002

* cited by examiner

*Primary Examiner*—Anthony D Stashick
*Assistant Examiner*—Niki M Eloshway
(74) *Attorney, Agent, or Firm*—Manabu Kanesaka

(57) ABSTRACT

An acceleration/deceleration mechanism is installed for a lid body rotatably supported on a main body. The mechanism includes a forcing device for forcing the lid body toward an open direction, a locking device for maintaining a closed state of the lid body relative to the main body in opposition to the force of the forcing device, and an acceleration/deceleration device situated between the lid body and the main body. The acceleration/deceleration device increasing a speed of opening of the lid body at less than a prescribed angle of opening of the lid body, and decreasing the speed of opening in excess of the prescribed angle of opening.

9 Claims, 6 Drawing Sheets

ACCELERATION/DECELERATION MECHANISM AND VEHICLE SMALL ARTICLE COMPARTMENT HAVING ACCELERATION/DECELERATION MECHANISM

BACKGROUND OF THE INVENTION AND RELATED ART STATEMENT

The present invention relates to an acceleration/deceleration mechanism for opening and closing a lid body that is supported to be capable of rotation on a main body, as well as a vehicle small article compartment having this acceleration/deceleration mechanism.

A container holder such as a vehicle small article compartment provided in a center console of an automobile, as shown in FIG. 6, includes a main body 100 and a lid body 102, A shaft 104 is provided on both sides of the lid body 102, and is arranged to be movable within a guide member 106.

A sector gear 108 is provided on the shaft 104, and a damping gear 110 is engaged with this sector gear 108. Therefore, when the shaft 104 moves inside the guide part 106, the force of a spring 112 for opening is damped by the engagement between the sector gear 108 and the damping gear 110, and the speed of opening of the lid body 102 is damped.

However, usually, when using a container holder 114, it is highly convenient that the lid body 102 be initially opened quickly when the lid body 102 is first opened from a fully closed position. On the other hand, when the lid body 102 is approaching a fully open position, it is better that it opens slowly in order to alleviate the impact force due to interference between the lid body 102 and the main body 100.

The above described prior art arrangement is disclosed in the publication of Japanese Unexamined Patent Publication No. 2002-178818.

The object of the present invention, in consideration of the above circumstances, is to provide an acceleration/deceleration mechanism that can open the lid body quickly when the lid body is on the side of the start of opening and can open the lid body slowly when the lid body is on the side of the end of opening, as well as a vehicle small article compartment having this acceleration/deceleration mechanism.

Further objects and advantages of the invention will apparent from the following description of the invention.

SUMMARY OF THE INVENTION

A first aspect of the invention comprises an arrangement having forcing or biasing means for forcing a lid body which is pivotally mounted on a main body, toward an open position; a locking means for maintaining the lid body in a closed position in opposition to the force of the forcing means; and an acceleration/deceleration means for increasing the speed of opening of the lid body at less than a prescribed angle of opening of the lid body, and slowing the speed of opening when in excess of the prescribed angle of opening.

In accordance with this aspect of the invention, the lid body is forced toward the open direction by the forcing means, and the closed state of the lid body is maintained in opposition to the force of the forcing means by the locking means. Here, it is arranged so that the speed of opening of the lid body is increased by the acceleration/deceleration means at less than a prescribed angle of opening of the lid body, and the speed of opening of the lid body is reduced when in excess of the prescribed angle of the fully opening position of the lid body.

More specifically, when the locking means is released and the lid body is opened under the influence of the forcing means, in the interval between the closed state of the lid body and the prescribed angle of opening, because the speed of opening of the lid body is accelerated by the acceleration/deceleration means in addition to that produced by the force of the forcing means, the lid body is opened quickly.

On the other hand, in excess of the prescribed angle of opening of the lid body, because the speed of opening of the lid body is decelerated by the acceleration/deceleration means, the lid body is opened slowly, and when the lid body is completely opened, the impact due to interference with the main body can be alleviated. Therefore, it becomes no longer necessary to provide shock-absorbing material for absorbing that impact force on the main body, and reduction in cost can be achieved.

A further aspect of this invention resides in that the acceleration/deceleration mechanism comprises a coil spring, one end of which is attached to a shaft part provided on the lid body and the other end of which is attached to the main body. In this arrangement, the coil spring becomes shortest in total length at the prescribed angle of opening and stretches in the fully open and fully closed states of the lid body.

This arrangement is such that the coil spring becomes shortest in total length at the prescribed angle of opening of the lid body, and in the closed state and the open state of the lid body, the spring stretches and assumes a condition wherein elastic force is accumulated therein.

By this, with the prescribed angle of opening of the lid body as a reference, in the interval from the closed state of the lid body to the prescribed angle of opening, the force of the coil spring in which elastic force was accumulated comes to be applied to the shaft part. Therefore, the speed of opening of the lid body is increased.

Also, in the interval from the prescribed angle of opening to the open state, because elastic force is gradually accumulated in the coil spring, a force in the direction opposite to the force of the coil spring comes to be applied to the shaft part. Therefore, the speed of opening of the lid body is decreased.

Thus, due to the fact that the lid body is accelerated and then decelerated by one coil spring, a reduction of cost can be achieved as compared with the case of using a damper.

Also, because elastic force is accumulated in the coil spring in the closed state of the lid body, when the lid body is in the closed state, a force toward the open direction is applied to the lid body. Therefore, in the closed state of the lid body, because the lid body is restricted in movement by the locking means in a state being forced toward the open direction, flapping at the free end of the lid body can be suppressed.

A further aspect of the invention resided in that the acceleration/deceleration mechanism has plural attachment parts provided on the main body for connecting the second end of the coil spring to the main body.

According to this aspect of the invention, due to the fact that plural attachment parts for the other end of the coil spring are provided on the main body, the reference position for accelerating or decelerating the speed of opening of the lid body, being the so-called prescribed angle of opening of the lid body, can be selectively changed.

According to a fourth aspect of the invention, the above mentioned acceleration/deceleration mechanism is further provided with a damping means for damping the force of the forcing means.

In according with this fourth aspect of the invention due to the fact that a damping means for damping the force of the forcing means is provided, the speed of opening of the lid body is decelerated, and the operation of opening of the lid body can be made even quieter, and a feeling of high quality can be imparted to the acceleration/deceleration mechanism.

A fifth aspect of the invention resides in that the acceleration/deceleration mechanism mentioned above is such that the damping means comprises a sector gear which is formed on the shaft part, and a damping gear which is provided on the main body and engages with the sector gear and damps the force of the forcing means.

In accordance with this fifth aspect of the invention, due to the fact that a sector gear is formed on the shaft part and a damping gear for damping the force of the forcing means is made to engage with this sector gear, the operation of opening of the lid body can be made smooth, and a further feeling of high quality can be given to the acceleration/deceleration mechanism.

A sixth aspect of the invention resides in that the lid and main bodies form part of a small vehicle article compartment.

In accordance with the above aspects of the invention, because the interval from the closed state of the lid body to the prescribed angle of opening, is short because the speed of opening of the lid body is accelerated by the acceleration/deceleration means in addition to the force of the forcing means, the lid body is opened quickly. On the other hand, when the lid body reaches an angle excess of the prescribed angle, because the speed of opening of the lid body is decelerated by the acceleration/deceleration means, the lid body is then opened slowly, and when the lid body is completely opened, because the impact force due to interference with the main body is attenuated, it is no longer necessary to provide a shock-absorbing material for absorbing that impact force on the main body, and reduction of cost can be achieved.

In accordance with the second aspect of the invention, due to the fact that the lid body is accelerated or decelerated by one coil spring, a reduction in cost can be achieved as compared with the case using a damper. Also, because elastic force is accumulated in the coil spring in the closed state of the lid body, when the lid body is in the closed state, a force toward the open direction comes to be applied to the lid body. Therefore, in the closed state of the lid body, because the lid body is restricted in movement by the locking means in a state being forced toward the open direction, flapping/vibrating movement of the free end of the lid body can be suppressed.

In accordance with the third aspect of the invention, due to the reference position for accelerating or decelerating the speed of opening of the lid body can be changed.

In accordance with the fourth aspect of the invention, because the speed of opening of the lid body is decelerated, the operation of opening of the lid body can be made even quieter, and a feeling of high quality can be imparted by the acceleration/deceleration mechanism.

In accordance with the fifth aspect of the invention, because the operation of opening of the lid body can be made smooth, an additional feeling of high quality can be imparted by the acceleration/deceleration mechanism.

DETAILED DESCRIPTION OF PREFERRED EMBODIMENTS

Figure 1:
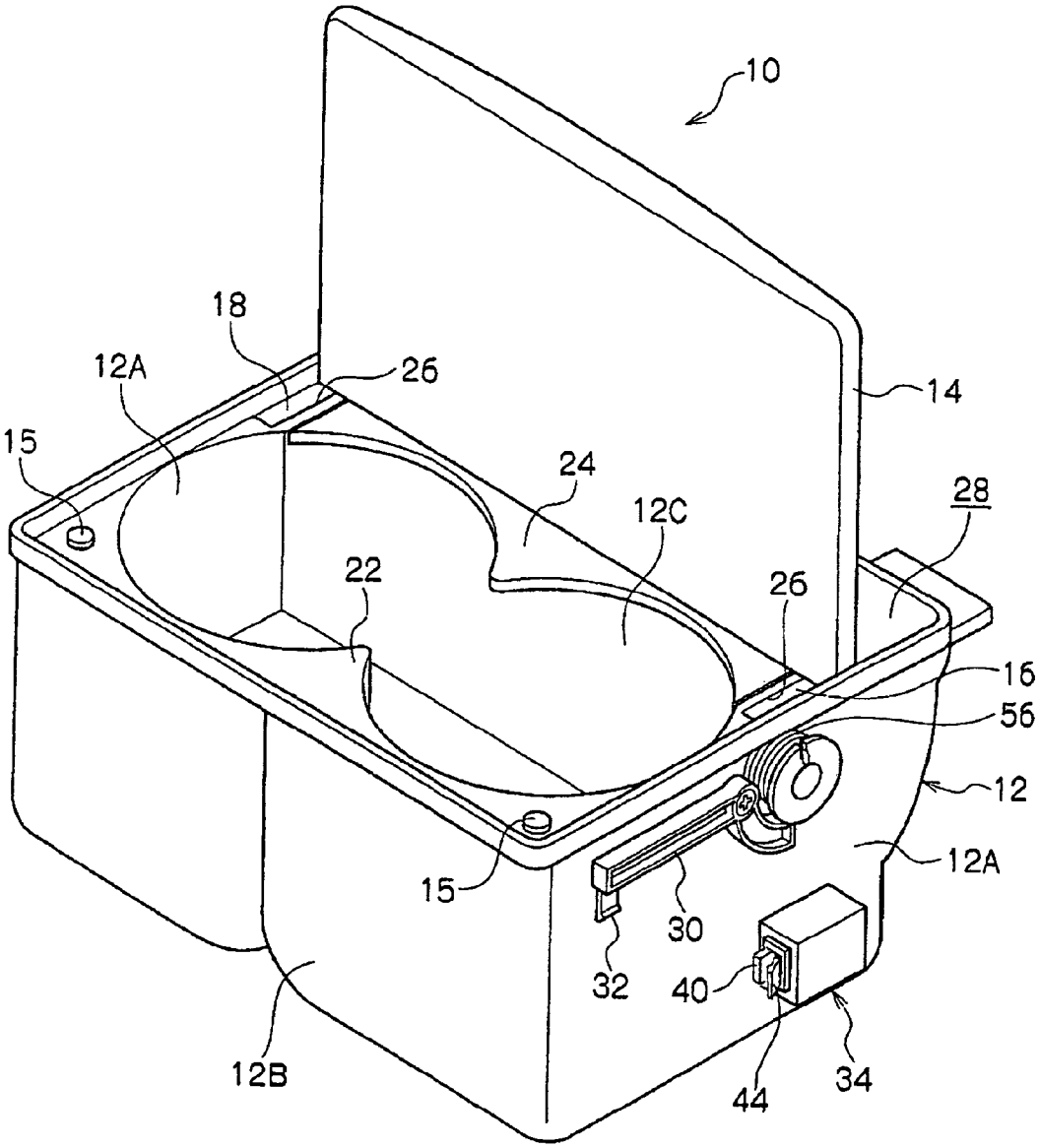
FIG. 1 is a perspective view showing a container holder having an acceleration/deceleration mechanism pertaining to an embodiment of the present invention.
Figure 2:
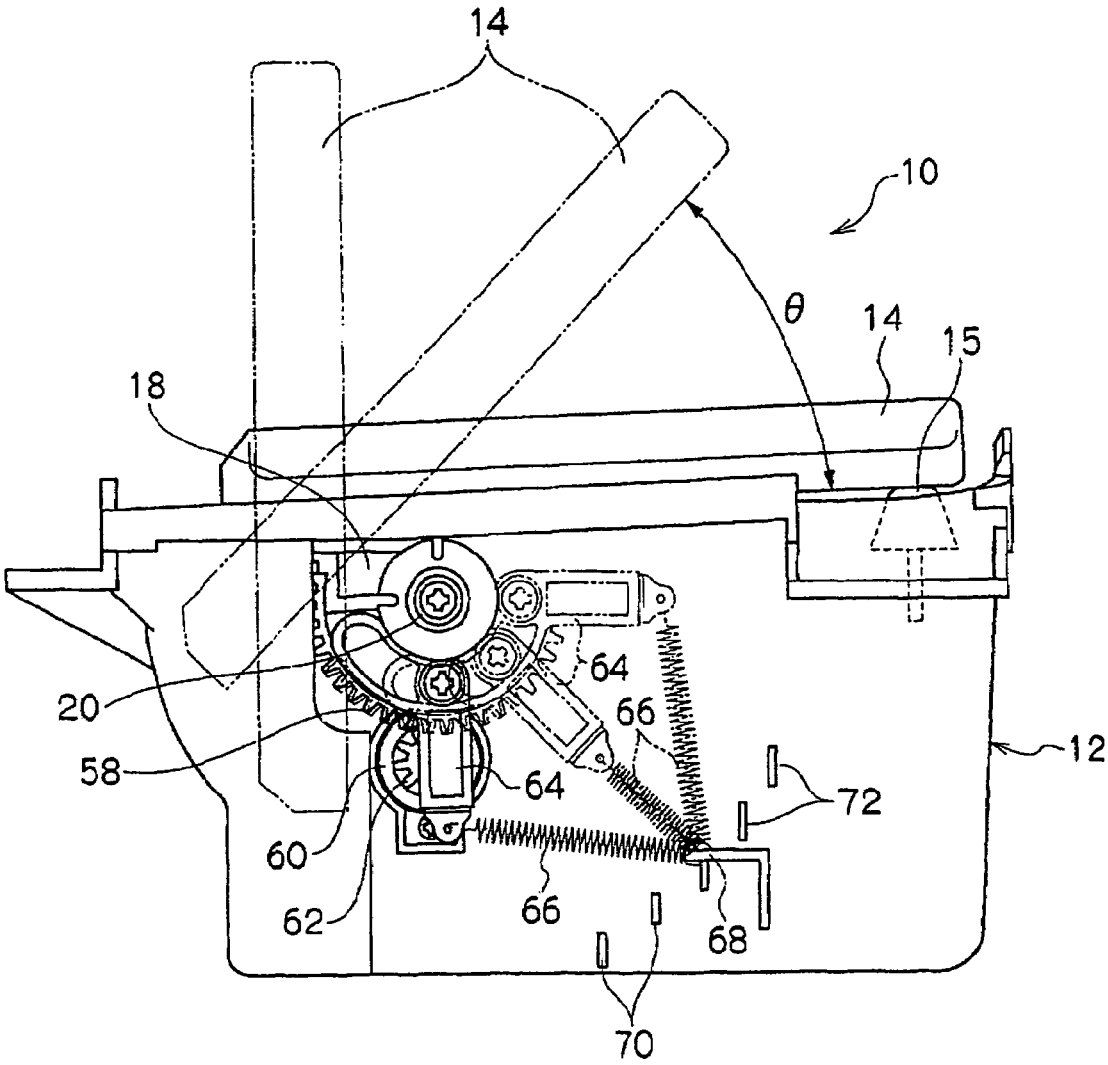
FIG. 2 is a side view showing the relationship between the coil spring and the angle of opening of the lid body constituting an acceleration/deceleration mechanism pertaining to an embodiment of the present invention.

FIG. 1 and FIG. 2 show a container holder 10 as a vehicle small article compartment pertaining to one embodiment of the present invention. The container holder 10 is disposed in the center console which is disposed between the driver seat and passenger seat of a vehicle (not illustrated), and it can be stored inside an attachment recess part provided in the center console.

The container holder 10 is constituted by a box-like holding part 12 (main body) and a lid body 14, and an opening of the holding part 12 is opened and closed by the lid body 14. A pair of shaft support plates 16, 18 is provided on both sides of the lid body 14, and shafts 20 are disposed through them. These shafts 20 are fixed to a perimeter walls 12A constituting the holding part 12, and the shaft support plates 16, 18 are configured to be rotatable around shafts 20.

The holding part 12 is arranged to be capable of holding containers having large external dimensions such as plastic bottles, and at about the middle of a perimeter wall 12B of the holding part 12 at which the free end of the lid body 14 is capable of contacting, a bearing part 22 which is mountain shaped going toward the inside of the holding part 12 is provided.

Also, on the perimeter walls 12A positioned on both sides of the perimeter wall 12C facing opposite the perimeter wall 12B, a holding piece 24 which is mountain shaped going toward the inside of the holding part 12 is supported to be capable of rotation, and the holding piece 24 stands up so that it is held in the horizontal direction by a forcing means not illustrated. In this state, the holding piece 24 faces opposite the bearing part 22 and is made to hold containers between the front end surface of the holding piece 24 and the bearing part 22.

Also, a pair of receiving parts 26 is cut out on the shaft 20 sides of the perimeter walls 12A of the holding part 12. The shaft support plates 16, 18 are adapted to slide in these receiving parts 26, whereby they do not protrude from the perimeter walls 12A when the lid body 14 is opened, and the container holder 10 can be made compact.

Also, a lid body storage part 28 is provided on the back face side of the perimeter wall 12C of the holding part 12 so that the opened lid body 14 becomes capable of storing. By this, the lid body 14 can be made to stand up in the vertical direction so that the lid body 14 does not become an obstacle.

Furthermore, roughly cylindrical shock-absorbing members 15 made of rubber are provided in the corner parts of the perimeter wall 12B of the holding part 12, and it is made such that the underside of the lid body 14 does not directly contact with the upper surface of the perimeter wall 12B of the holding part 12 when the lid body 14 is closed.

Incidentally, a roughly L-shaped leg part 30 is provided on the front end part of the shaft support plate 16, and a claw part 32 is formed on the front end part of the leg part 30. Meanwhile, a latch device 34 is provided on the perimeter wall 12A of the holding part 12 so that the claw part 32 becomes capable of catching. As a latch device 34, for example, a device described in the publication of Japanese Unexamined Patent Publication No. H8-282382 previously filed by the present applicant(s) can be used.

Figure 5A:
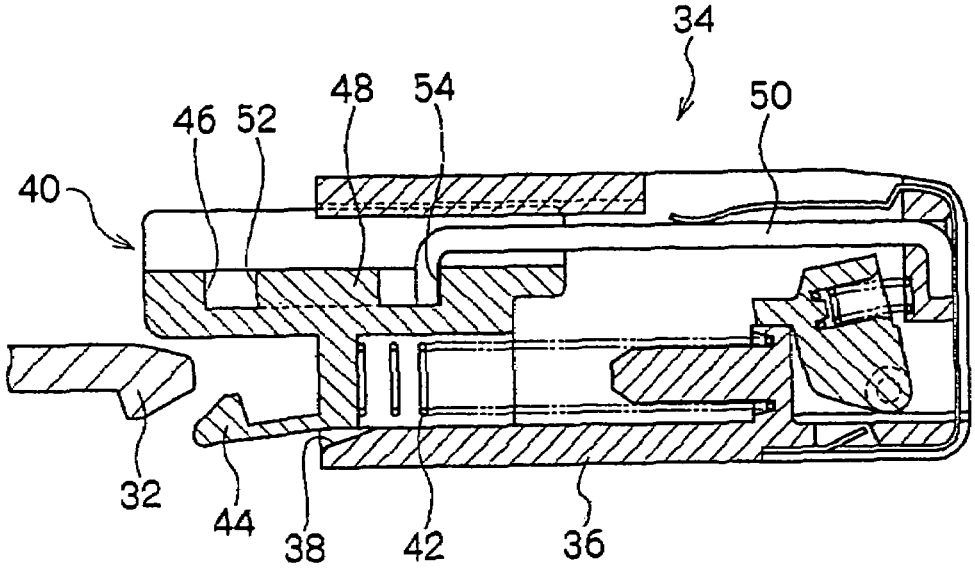
FIGS. 5(*a*) and 5(*b*) are sectional views showing a latch device provided on a container holder having an acceleration/deceleration mechanism pertaining to an embodiment of the present invention, wherein FIG. 5(*a*) shows the locked state of the claw part and the part coupled therewith, and FIG. 5(*b*) shows the unlocked state of the claw part and the part coupled therewith.
Figure 5B:
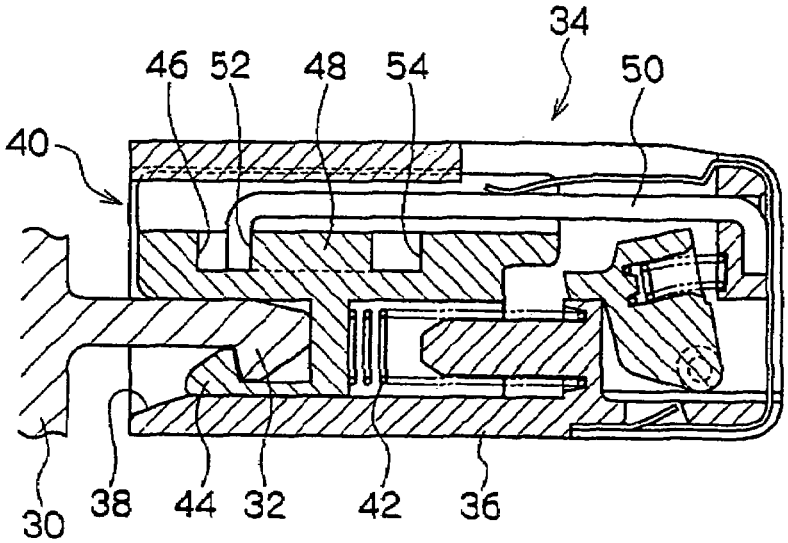
Figure 6:
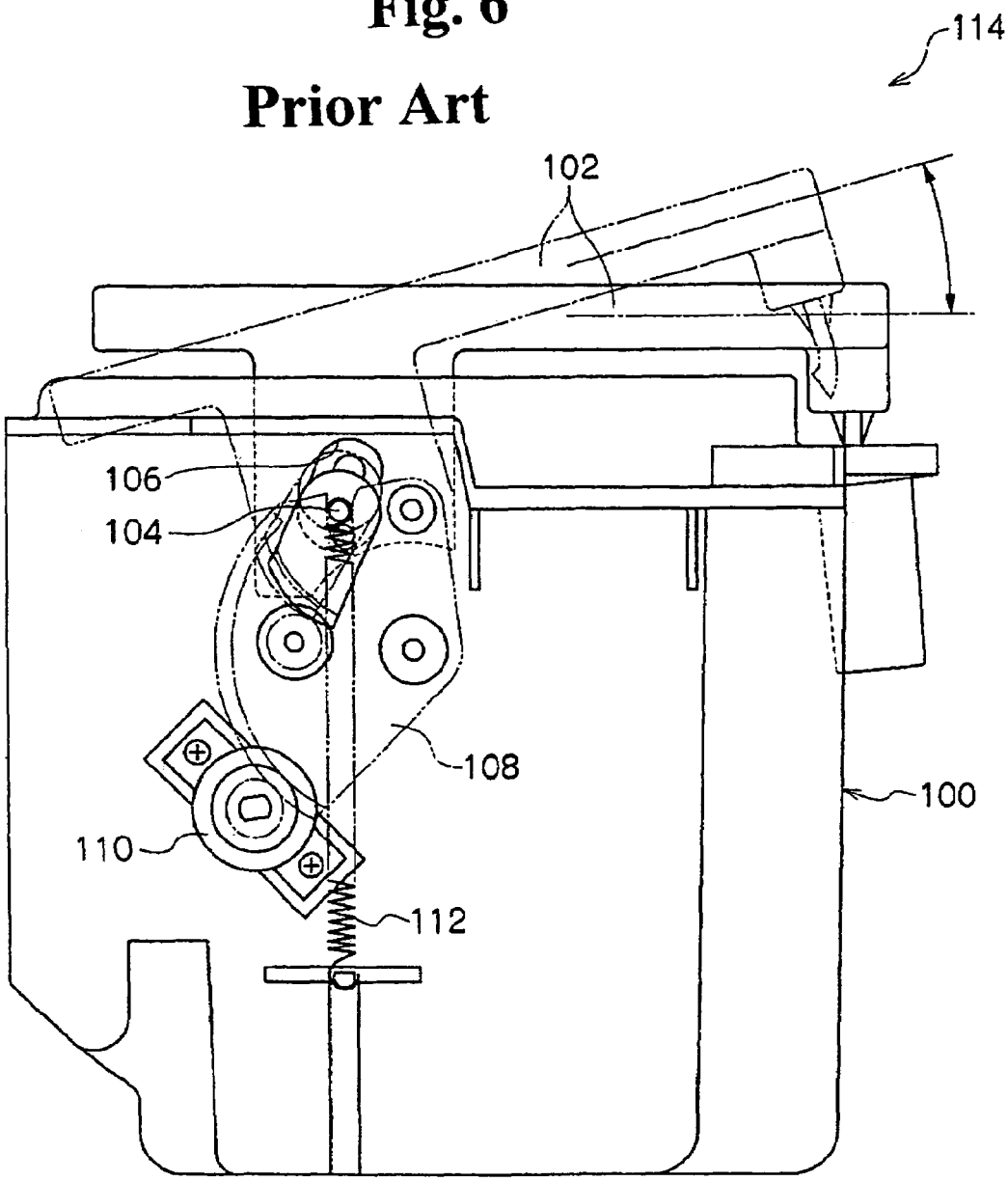
Fig. 6 Prior Art
FIG. 6 is a side view showing a conventional container holder.

More specifically, as shown in FIGS. 5(*a*) and 5(*b*), an opening 38 is provided on a case 36 of the latch device 34 so that the claw part 32 can be inserted. A latch main body 40 is received inside the case 36, and this latch main body 40 is forced toward the direction of popping out from the opening 38 by a spring 42 provided inside the case 36.

Also, a part coupled with 44 which is capable of coupling with the claw part 32 is provided on the front end side of the latch main body 40, and the claw part 32 is caught when the latch main body 40 is received inside the case 36 in a state in which the claw part 32 is coupled with the part coupled with 44.

Also, a recessed part 46 is provided on the back face side of the part coupled with 44 of the latch main body 40, and a cam 48 which is roughly heart shaped viewed from the front is provided inside the recessed part 46. A lock lever 50 which is attached to be capable of rocking in the depth of the latch main body 40 traces the outer perimeter of this cam 48.

When the latch main body 40 in the state having popped out from the opening 38, is pressed toward the direction opposite to the force of the spring 42 and is received inside the case 36, the lock lever 50 traces the outer perimeter of the cam 48 and is caught in a catching part 52, and the claw part 32 and the part coupled with 44 assume a locked state (see FIG. 5(*a*)).

From this state, when the latch main body 40 is pressed toward the direction in opposition to the force of the spring 42, the latched state of the lock lever 50 is released, the lock lever 50 traces the outer perimeter of the cam 48 and is caught in a catching part 54, the locked state between the claw part 32 and the part coupled with 44 is released (see FIG. 5(*b*)), the latch main body 40 pops out from the case 36, and the claw part 32 becomes uncaught from the part coupled with 44.

With an arrangement of the nature described above, when in a state in which the lid body 14 shown in FIG. 1 and FIG. 2 was moved toward a closed position by pushing the free end side of the lid body 14 and causing the claw part 32 and the part coupled with 44 to be locked, by again pressing the free end side of the lid body 14, the locked state between the claw part 32 and the part coupled with 44 is released, and the lid body 14 becomes capable of opening.

Here, one end of a torsion spring 56 is attached to the shaft support plate 16, the other end of the torsion spring 56 is attached to the perimeter wall 12A, and the lid body 14 is forced toward the direction of opening by means of the shaft support plate 16. Therefore, when the locked state between the claw part 32 and the part coupled with 44 is released by pressing the free end side of the lid body 14 in the state in which the lid body 14 is closed, the lid body 14 is automatically opened by the force of the torsion spring 56.

Thus, by providing the latch device 34 for maintaining the closed state of the lid body 14 on the perimeter wall 12A of the holding part 12 and making it such that it is not exposed inside the vehicle compartment, the aesthetic value of the container holder 10 is improved, and in addition, because there is no need to provide a claw part on the underside of the lid body 14, that claw part does not become an obstacle.

Meanwhile, a sector gear 58 is formed on the front end part of the shaft support plate 18, and a damping gear 62 of an oil-filled type rotary damper 60 which is fixed to the perimeter wall 12A of the holding part 12 is engaged with this sector gear 58, and when the lid body 14 is opened and closed, the damping force of the rotary damper 60 is transmitted to the shaft support plate 18.

Also, an attachment piece 64 is fixed to the shaft support plate 18, and one end of a coil spring 66 is attached to the front end of the attachment piece 64. The other end of the coil spring 66 is attached to an attachment part 68 provided on the perimeter wall 12A.

Here, the attachment part 68 is placed so that the total length of the coil spring 66 becomes shortest at a prescribed angle of opening θ of the lid body 14, and in the closed state and the open state of the lid body 14, the coil spring 66 stretches so that elastic force is accumulated in the coil spring 66.

Figure 3:
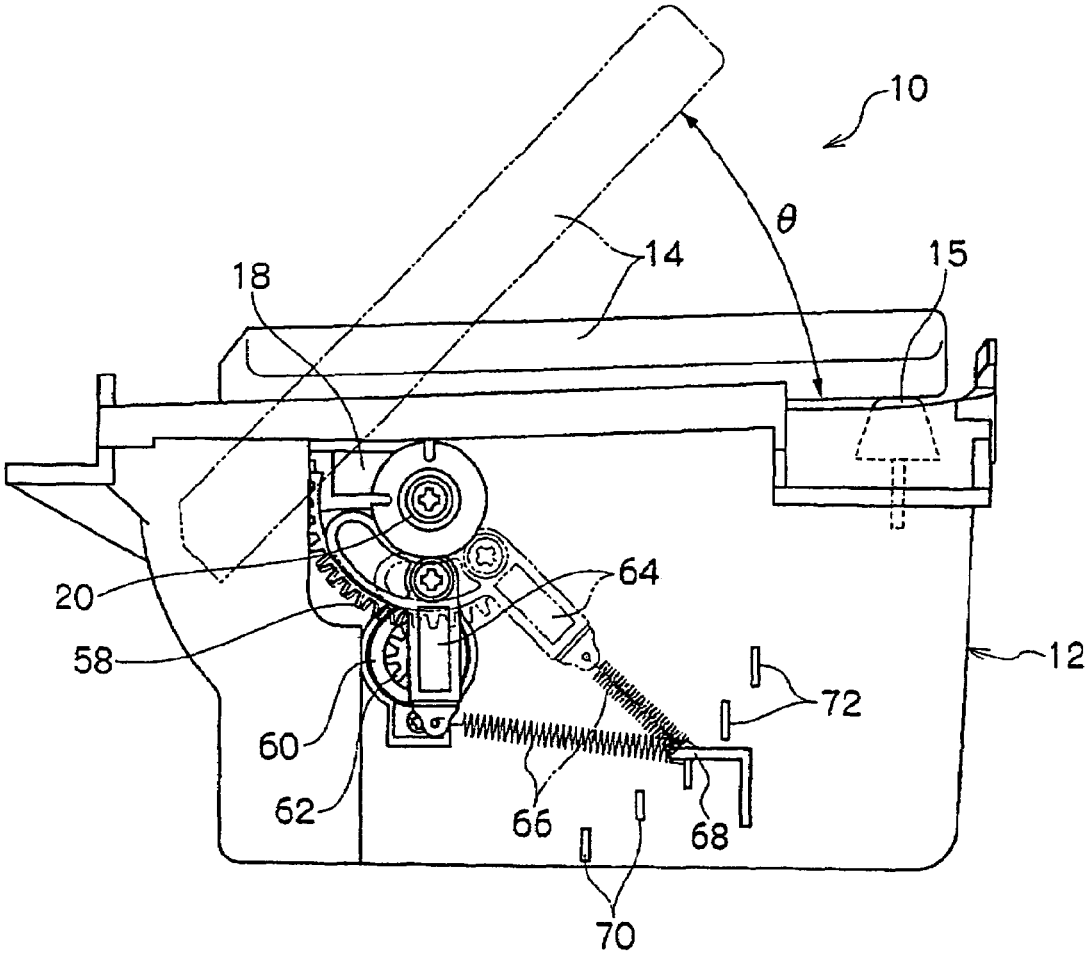
FIG. 3 is a side view showing the relationship between the coil spring and the angle of opening of the lid body constituting an acceleration/deceleration mechanism pertaining to an embodiment of the present invention.

By this, with the angle of opening θ of the lid body 14 as a reference, as shown in FIG. 3, in the interval from the closed state of the lid body 14 to the angle of opening θ, the force of the coil spring 66 in which elastic force was accumulated, in addition to the force of the torsion spring 56, comes to be applied to the shaft support part 18.

Figure 4:
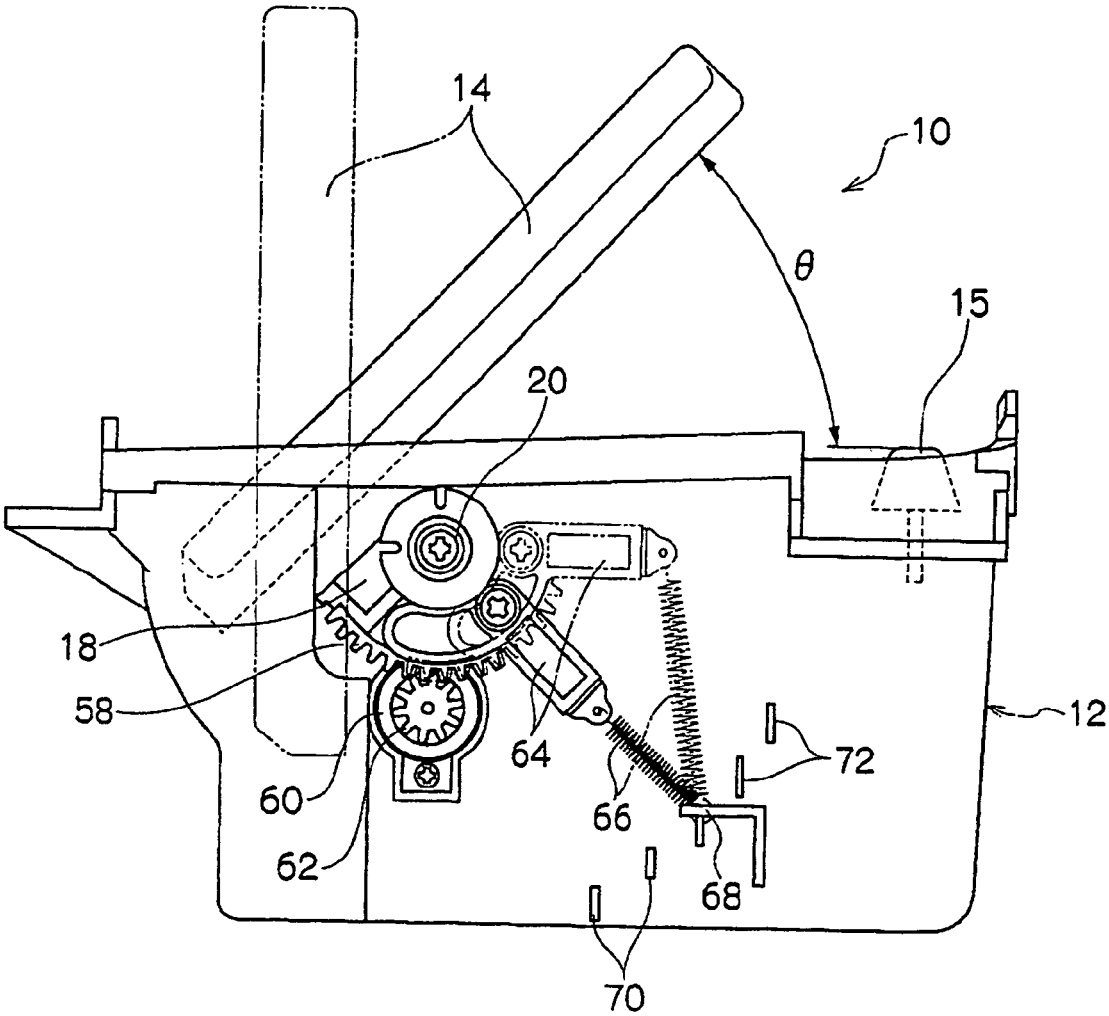
FIG. 4 is a side view showing the relationship between the coil spring and the angle of opening of the lid body constituting an acceleration/deceleration mechanism pertaining to an embodiment of the present invention.

Also, as shown in FIG. 4, in the interval from the angle of opening θ of the lid body 14 to the open state, because elastic force is gradually accumulated in the coil spring 66, a force in the direction in opposition to the force of the coil spring 66 comes to be applied to the shaft support plate 18.

Next, the operation of the container holder 10 pertaining to the embodiment of the present invention is explained.

As shown in FIG. 2, by causing the coil spring 66 to becomes shortest in total length at the prescribed angle of opening θ of the lid body 14, and making the coil spring 66 stretch in the closed state and the open state of the lid body 14, it is made such that the speed of opening of the lid body 14 is accelerated at less than the angle of opening θ of the lid body 14, and the speed of opening of the lid body 14 is decelerated when in excess of the angle of opening θ of the lid body 14.

That is, when the closed state of the lid body 14 due to the latch device 34 (see FIG. 1) is released and the lid body 14 is opened by the torsion spring 56, as shown in FIG. 3, in the interval from the closed state of the lid body 14 to the angle of opening θ, because the speed of opening of the lid body 14 is accelerated by the force of the coil spring 66 in addition to the force of the torsion spring 56, the lid body 14 is opened quickly.

On the other hand, as shown in FIG. 4, when in excess of the angle of opening θ of the lid body 14, because the speed of opening of the lid body 14 is decelerated by the force of the coil spring 66, the lid body 14 is opened more slowly, and when the lid body 14 is completely opened, the impact force due to interference with the holding part 12 is alleviated. Therefore, it becomes no longer necessary to provide a shock-absorbing material for absorbing that impact force on the holding part 12, and reduction of cost can be achieved.

Thus, by the fact that the lid body 14 is accelerated or decelerated by one coil spring 66, reduction of cost can be achieved compared with the case using a damper.

Also, because the coil spring 66 stretches and elastic force is accumulated in the coil spring 66 in the closed state of the lid body 14, when the lid body 14 is in the closed state, a force toward the open direction comes to be applied to the lid body 14.

Therefore, in the closed state of the lid body 14, a force comes to be applied in the direction in which the claw part 32 of the latch device 34 (see FIG. 5(*a*)) contacts with the side of the part coupled with 44. Accordingly, the claw part 32 is restricted in movement, the lid body 14 is restricted in movement by means of the claw part 32 and the shaft support plate 18, and flapping of the free end side of the lid body 14 can be suppressed.

Incidentally, by providing a sector gear 58 on the front end part of the shaft support plate 18 and causing a damping gear 62 of oil-filled type rotary damper 60 to be engaged with this sector gear 58, when the lid body 14 is opened and closed, the damping force of the rotary damper 60 is transmitted to the shaft support plate 18.

With this arrangement, the speed at which the lid body 14 is opened is reduced, and the operation of opening of the lid body 14 is made even quieter. Also, because it is a damping method by gear, the operation of opening of the lid body 14 can be smoothed, and a feeling of high quality can be imparted to the container holder 10.

Furthermore, attachment parts 70, 72 also may be provided in addition to the attachment part 68 on the perimeter wall 12A of the holding part 12. By this, the reference position for accelerating or decelerating the speed of opening of the lid body 14, being the so-called prescribed angle of opening (here, angle of opening θ) of the lid body 14, can be changed, and the speed of opening of the lid body 14 can be adjusted.

When the attachment part 68 is changed to the attachment part 70, when the lid body 14 is in the closed state, the elastic force accumulated in the coil spring 66 becomes smaller than with the attachment part 68, but when the lid body 14 is in the open state, the elastic force accumulated in the coil spring 66 becomes greater than with the attachment part 68.

That is, when the attachment part 68 is changed to the attachment part 70, the prescribed angle of opening of the lid body 14 becomes smaller, and during opening of the lid body 14, the speed of opening of the lid body 14 which is accelerated by the force of the coil spring 66 becomes somewhat slower than in the case with the attachment part 68, but the decelerating force on the speed of opening in the course when the lid body 14 is completely opened becomes somewhat greater than in the case with the attachment part 68, and the impact force due to interference with the holding part 12 can be further alleviated.

When the attachment part 68 is changed to one of the attachment parts 72, when the lid body 14 is in the closed state, the elastic force accumulated in the coil spring 66 becomes greater than with the attachment part 68, but when the lid body 14 is in the open state, the elastic force accumulated in the coil spring 66 becomes smaller than with the attachment part 68.

That is, when the attachment part 68 is changed to one of the attachment part 72, the prescribed angle of opening of the lid body 14 becomes larger, and the decelerating force on the speed of opening in the course when the lid body 14 is completely opened becomes somewhat smaller than in the case with the attachment part 68, but during opening of the lid body 14, the speed of opening of the lid body 14 which is accelerated by the force of the coil spring 66 can be made even faster than in the case with the attachment part 68, and the lid body 14 can be opened quickly.

Although a container holder was explained in this embodiment, it is not limited to this because it may be anything that opens and closes a lid body on a main body. For example, it also may be applied to a small article compartments, ashtrays, or home electric appliances such as CD players and notebook computers.

Although only a limited number of embodiments have been described above, the various variations and modifications can be made without departing from the scope of the appended claims to those skilled in the art to which the present invention pertains or most closely pertains given the preceding disclosure.

For example, while a coil spring has been described as being used as the element which produces biasing effect in the disclosed embodiments of the present invention, the invention is in no way limited to such a device and can be replaced with any suitable elastic arrangement that will apply a bias in a similar manner. Further the invention is not limited to a single spring/elastic member and combinations of springs/elastic members that produce/result in the generation of non-linear biasing forces (for example) can be used if so desired.

The disclosure of Japanese Patent Application No. 2004-238770 filed on Aug. 18, 2004 is incorporated herein.

What is claimed is:

1. An acceleration/deceleration mechanism for a lid body rotatably supported on a main body, comprising:

forcing means for forcing the lid body toward an open direction;

locking means for maintaining a closed state of the lid body relative to the main body in opposition to force of the forcing means; and acceleration/deceleration means installed between the lid body and the main body, said acceleration/deceleration means increasing a speed of opening of the lid body at less than a prescribed angle of opening of the lid body, and decreasing the speed of opening in excess of the prescribed angle of opening, wherein the acceleration/deceleration means comprises a coil spring having a first end attached to the lid body, and a second end attached to the main body, the coil spring being configured to become shortest in total length at the prescribed angle of opening of the lid body and stretching in the open and closed states of the lid body.

2. An acceleration/deceleration mechanism according to claim 1, wherein said forcing means is a coil spring attached to a shaft part of the lid body.

3. An acceleration/deceleration mechanism according to claim 2, wherein said locking means includes a claw part attached to a shaft support plate of the lid body, and a latch device formed at one side of the main body engaging the claw part.

4. An acceleration/deceleration mechanism according to claim 1, wherein plural attachment parts for the second end of the coil spring are provided on the main body.

5. An acceleration/deceleration mechanism according to claim 1, further comprising damping means for damping the force of the forcing means.

6. An acceleration/deceleration mechanism according to claim 5, wherein the damping means comprises a sector gear disposed on a shaft part, and a damping gear provided on the main body and engaging the sector gear for damping the force of the forcing means.

7. A vehicle small article compartment, comprising the lid body, the main body, and the acceleration/deceleration mechanism according to claim 1.

8. An acceleration/deceleration mechanism according to claim 1, wherein said coil spring is arranged between the lid body and the main body such that the coil spring pulls the lid body at the open state of the lid body, and pushes the lid body at the closed state.

9. An acceleration/deceleration mechanism according to claim 8, wherein the forcing means is a lid coil spring for opening the lid body so that when the lid body in the closed state is opened, the coil spring and the lid coil spring operate to open the lid body, and after the prescribed angle of opening of the lid body, the coil spring pulls the lid body while the lid coil spring continues to push the lid body.

* * * * *